US007904003B2

(12) United States Patent
Kunihiro

(10) Patent No.: US 7,904,003 B2
(45) Date of Patent: Mar. 8, 2011

(54) DEVELOPING DEVICE AND IMAGE FORMING APPARATUS

(75) Inventor: Hisashi Kunihiro, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 171 days.

(21) Appl. No.: 12/346,911

(22) Filed: Dec. 31, 2008

(65) Prior Publication Data

US 2009/0180812 A1 Jul. 16, 2009

(30) Foreign Application Priority Data

Jan. 11, 2008 (JP) ..... 2008-005019

(51) Int. Cl.
*G03G 15/08* (2006.01)

(52) U.S. Cl. ..... 399/254; 399/267

(58) Field of Classification Search ..... 399/253, 399/254, 255, 258, 267; 347/140
See application file for complete search history.

(56) References Cited

U.S. PATENT DOCUMENTS

| | | | | |
|---|---|---|---|---|
| 4,373,468 | A * | 2/1983 | Suda et al. | 399/258 X |
| 6,266,507 | B1 * | 7/2001 | Nagahama et al. | 399/267 X |
| 6,317,576 | B1 * | 11/2001 | Ishida et al. | 399/267 X |
| 6,415,125 | B1 | 7/2002 | Yamamoto et al. | |
| 2005/0002699 | A1 | 1/2005 | Tamura et al. | |
| 2006/0182470 | A1 | 8/2006 | Tamura et al. | |

FOREIGN PATENT DOCUMENTS

| | | | |
|---|---|---|---|
| JP | 4-070778 | A | 3/1992 |
| JP | 10-063081 | | 3/1998 |
| JP | 2000-089550 | | 3/2000 |
| JP | 2001-92251 | A | 4/2001 |
| JP | 2004-333708 | A | 11/2004 |
| JP | 2006-098882 | A | 4/2006 |
| JP | 2006-243515 | A | 9/2006 |

* cited by examiner

*Primary Examiner* — Sandra L Brase
(74) *Attorney, Agent, or Firm* — Nixon & Vanderhye, PC

(57) ABSTRACT

A developing device includes: a first screw provided in a first carrying path, the first screw rotating so as to simultaneously stir the developer and carry the developer in the first carrying path in a predetermined direction; a second screw provided in a second carrying path, the second screw rotating so as to simultaneously stir the developer and carry the developer in the second carrying path in an opposite direction from the predetermined direction; a first communicating path communicating the first carrying path with the second carrying path; a second communicating path communicating the first carrying path with the second carrying path, the second communicating path being formed downstream of the first communicating path in the opposite direction; and a developer bearing member for bearing the developer in the second carrying path so as to supply the toner included in the developer onto a photoreceptor, the toner being supplied through a supply opening to the first carrying path, wherein the developing device includes a magnet at a position higher than a shaft of the first screw, the magnet forming a magnetic brush from the magnetic carrier in the first carrying path. This reduces problematic scattering of toner and photographic fog in images.

4 Claims, 9 Drawing Sheets

DEVELOPING DEVICE AND IMAGE FORMING APPARATUS

This Nonprovisional application claims priority under 35 U.S.C. §119(a) on Patent Application No. 005019/2008 filed in Japan on Jan. 11, 2008, the entire contents of which are hereby incorporated by reference.

FIELD OF THE TECHNOLOGY

The present technology relates to a developing device included in an electrophotographic image forming apparatus, the developing device using a two-component developer including toner and magnetic carrier.

BACKGROUND OF THE TECHNOLOGY

Conventionally, electrophotographic image forming apparatuses such as copiers, printers, and facsimile machines have been known. Such electrophotographic image forming apparatuses are arranged such that (i) an electrostatic latent image is formed on the surface of a photoreceptor (toner image bearing member), (ii) the electrostatic latent image is supplied with toner from a developing device so as to be developed, and (iii) a toner image formed by such development is transferred onto a sheet such as a paper and is then fixed thereon.

In recent years, an image forming apparatus capable of forming high-quality color images frequently uses a two-component developer (hereinafter also referred to simply as "developer"), which has superior stability in charging of toner. The developer includes toner and carrier. Stirring the toner and the carrier in the developing device causes friction therebetween. This friction gives proper electrical charge to the toner. The electrically charged toner is supplied onto the surface of a developer bearing member (developing roller). The toner on the developer bearing member is moved by electrostatic attraction onto an electrostatic latent image formed on an image bearing member (photoreceptor). This consequently forms a toner image on the photoreceptor.

Recently, there has been a demand for a high-speed, downsized image forming apparatus. This has in turn necessitated rapid and accurate supply of a developer onto a toner image bearing member. In view of this, Patent Document 1 below discloses an image forming apparatus that employs a developing device of a circulation type for rapid and sufficient electrical charging of a developer and also for rapid transport of the developer. As shown in Patent Document 1, the developing device of the circulation type includes: a developer carrying path through which the developer is circulatively carried; and a developer carrying member by which the developer is simultaneously stirred in and carried through the developer carrying path. The developer carrying member is a screw having (i) a wing body in the form of a feed screw and (ii) a screen member like a mesh.

[Patent Document 1]
Japanese Unexamined Patent Application Publication No. 63081/1998 (Tokukaihei 10-63081; published on Mar. 6, 1998)

[Patent Document 2]
Japanese Unexamined Patent Application Publication No. 89550/2000 (Tokukai 2000-89550; published on Mar. 31, 2000)

The above developing device of the circulation type is arranged such that, when the toner density of the developer in the developing device reaches below a predetermined value, toner is supplied to the developer carrying path from a toner hopper, a toner bottle or the like.

Unfortunately, according to the conventional developing devices of the circulation type, such toner supplied from the toner hopper to the developer carrying path would be circulatively carried in the form of aggregates in some cases, without being sufficiently mixed with the developer preexisting in the developing device already. In other words, the toner separated from the carrier would be circulatively carried. This disadvantageously causes insufficiently charged toner (toner having a small amount of charge) to be supplied onto the developer bearing member.

The supply of such insufficiently charged toner onto the developer bearing member more likely leads to a problem that the toner scatters off the developer bearing member. This makes the interior of the image forming apparatus dirty and/or stains a formed image. In addition, the supply of insufficiently charged toner onto the developer bearing member is also associated with another problem that electrostatic force for holding the toner on the surface of the carrier is consequently reduced. As a result, the toner is more likely adhered to an area where no image is to be formed. This causes photographic fog.

SUMMARY OF THE TECHNOLOGY

It is an object of the technology to reduce problematic scattering of toner and photographic fog in a developing device included in an electrophotographic image forming apparatus, by preventing supply of insufficiently charged toner to a developer bearing member.

A developing device includes: first and second carrying paths for carrying a developer including toner and magnetic carrier; a first screw provided in the first carrying path, the first screw rotating so as to simultaneously stir the developer and carry the developer in the first carrying path in a predetermined direction; a second screw provided in the second carrying path, the second screw rotating so as to simultaneously stir the developer and carry the developer in the second carrying path in an opposite direction from the predetermined direction; a first communicating path communicating the first carrying path with the second carrying path; a second communicating path communicating the first carrying path with the second carrying path, the second communicating path being formed downstream of the first communicating path in the opposite direction; and a developer bearing member for bearing the developer in the second carrying path so as to supply the toner included in the developer onto a photoreceptor, the toner being supplied through a supply opening to the first carrying path, the developer being circulatively carried through the first carrying path, the first communicating path, the second carrying path, and the second communicating path, in this order, wherein the developing device comprises a magnet at a position higher than a shaft of the first screw, the magnet forming a magnetic brush from the magnetic carrier in the first carrying path.

Therefore, even when the developer that has been in the first carrying path already and a toner aggregate formed of supplied toner are carried in the first carrying path while remaining separate from each other, the flow of the developer and the toner aggregate is temporarily stemmed by the magnetic brush so that the toner aggregate is trapped by the magnetic brush until the toner in the toner aggregate is mixed with the developer. This prevents the toner from being carried in the form of aggregates through the first carrying path to the second carrying path, and thereby prevents such a problem that toner with insufficient electrical charge is supplied onto the developer bearing member. This consequently reduces problematic scattering of toner and photographic fog in images.

In other words, according to the above developing device, since the toner aggregate is trapped by the magnetic brush until the toner in the toner aggregate is mixed with the developer, the toner can be sufficiently mixed with the developer, and this mixing enables sufficient charging of toner by means of friction between the toner and the carrier, and in turn allows sufficiently charged toner to be supplied onto the developer bearing member. This consequently reduces problematic scattering of toner and photographic fog in images.

According to a developing device of Patent Document 2 above, a magnet for forming a magnetic brush is positioned so as to lie at a position substantially as high as the shaft of a carrying screw. This causes a large portion of the magnetic brush formed by the magnet to be in contact with the shaft at its front end and, consequently, heat generated by friction between the magnetic brush and the shaft causes the developer to melt. This unfortunately gives rise to a problem of developer aggregation.

In contrast, according to the arrangement of the developing device, the magnet is provided at a position higher than the shaft of the first screw. This allows suppressing the number of bristles of the magnetic brush, the bristles being in contact with the shaft in the first carrying path. This in turn allows reducing an area of the shaft, the area being in contact with the magnetic brush, thereby reducing the amount of heat generated by friction between the shaft and the magnetic brush. This consequently prevents occurrence of the problem of developer aggregation, arising from the arrangement of the developing device of Patent Document 2.

Additional objects, features, and strengths of the technology will be made clear by the description below. Further, the advantages will be evident from the following explanation in reference to the drawings.

DESCRIPTION OF THE EMBODIMENTS

A developing device will be described below. Firstly, an image forming apparatus including the developing device is described, before the developing device is described.

[Arrangement of the Image Forming Apparatus]

Figure 2:
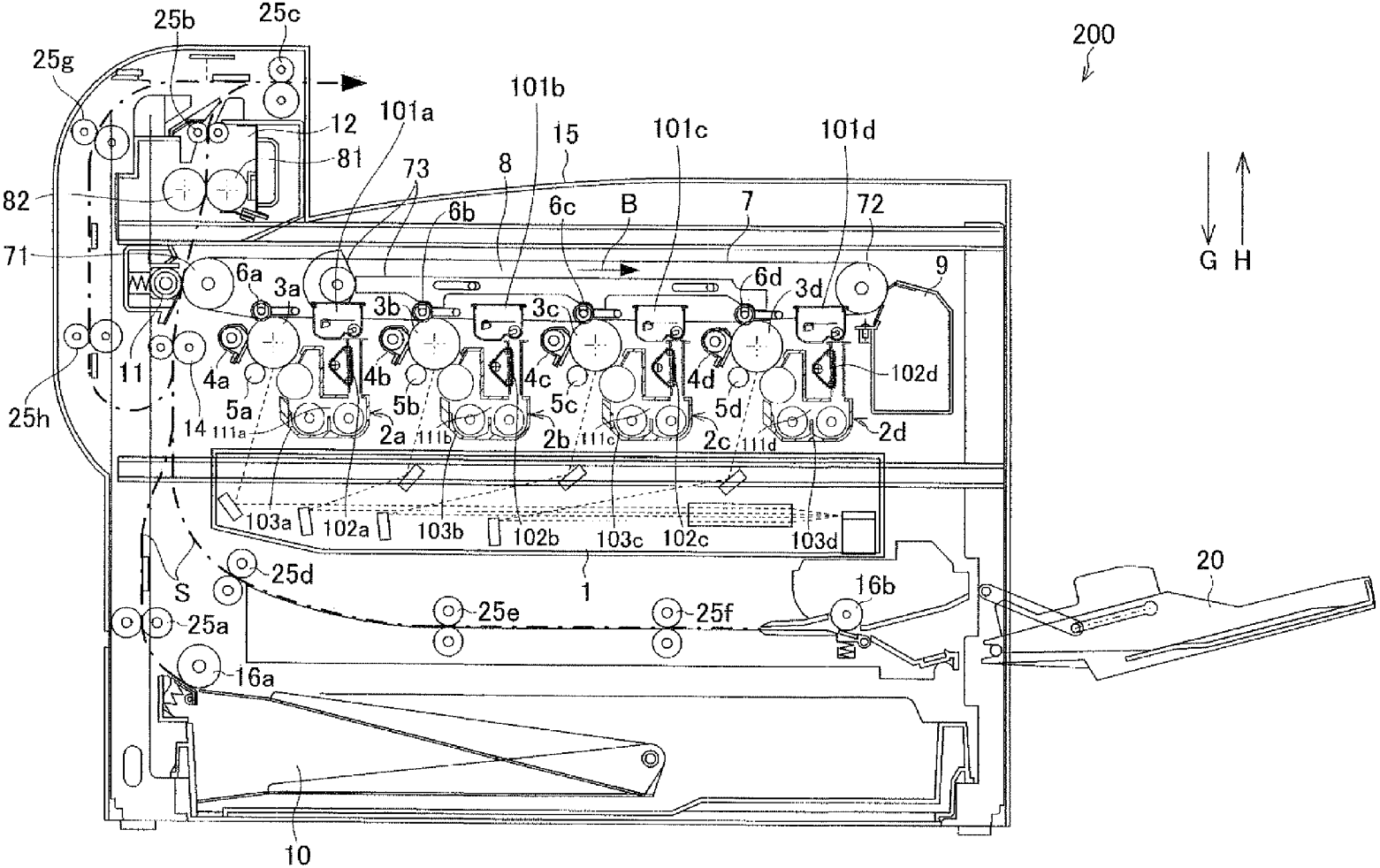
FIG. 2 is a schematic view illustrating an interior arrangement of an image forming apparatus including the developing device in FIG. 1.

FIG. 2 is a schematic view illustrating interior arrangement of an image forming apparatus 200 including the developing device according to the present embodiment. In the drawings attached to the specification of the present application, the vertical direction (direction in which gravity acts; direction downward from above) is referred to as the G direction, whereas the direction opposite from the G direction is referred to as the H direction.

The image forming apparatus 200 is an electrophotographic printer, which forms multicolor or single-color images on a predetermined sheet (recording paper; recording medium) according to externally transferred image data. A scanner and/or the like may be provided above the image forming apparatus 200.

The image forming apparatus 200 is arranged such that image data respectively for color components of black (K), cyan (C), magenta (M), and yellow (Y) is dealt with so that a black image, a cyan image, a magenta image, and/or a yellow image is formed correspondingly, and that a color image is formed by overlapping those images of the above color components as appropriate. Accordingly, as illustrated in FIG. 2, the image forming apparatus 200 includes: developing devices 2 (2*a*, 2*b*, 2*c*, 2*d*); photoreceptor drums 3 (3*a*, 3*b*, 3*c*, 3*d*); charging devices 5 (5*a*, 5*b*, 5*c*, 5*d*); and cleaner units 4 (4*a*, 4*b*, 4*c*, 4*d*), each in a set of four, in order to form an image of each color component. In other words, the image forming apparatus 200 includes four image forming stations (image forming sections) each of which includes one each of the developing devices 2, the photoreceptor drums (photoreceptors) 3, the charging devices 5, and the cleaner units 4.

The referential codes "a", "b", "c", and "d" indicate that the specific members referred to as those are used to form black images, cyan images, magenta images, and yellow images, respectively. The image forming apparatus 200 further includes: an exposure unit 1; a fixing unit 12; a sheet carrying path S; a paper feeding tray 10; and a paper output tray 15.

The charging devices 5 each serve to uniformly charge a surface of a corresponding one of the photoreceptor drums 3 to a predetermined potential. The charging devices 5 may be of such a type as a contact brush type or a non-contact type, other than a contact roller type illustrated in FIG. 2.

As illustrated in FIG. 2, the exposure unit 1 is a laser scanning unit (LSU) including a laser irradiation section and reflection mirrors. However, it should be noted that, other than a laser scanning unit, an EL or LED writing head in which light-emitting elements are arranged in array, may be used as the exposure unit 1. In accordance with image data entered, the exposure unit 1 exposes the photoreceptor drums 3 which are electrically charged. As a result, an electrostatic latent image corresponding to the image data is formed on the surface of each of the photoreceptor drums 3.

The developing devices 2 each visualize (develop) an electrostatic latent image formed on a corresponding one of the photoreceptor drums 3, with one of the toners of K, C, M, and Y. The developing devices 2 (2*a*, 2*b*, 2*c*, and 2*d*) each include: a toner hopper 101 (101*a*, 101*b*, 101*c*, or 101*d*); a toner transport mechanism 102 (102*a*, 102*b*, 102*c*, or 102*d*); and a developing tank 111 (111*a*, 111*b*, 111*c*, or 111*d*). The toner hoppers (toner storage tanks) 101 are disposed on the H direction side of the developing tanks 111, and store unused toner (toner in the form of powder). The toner is supplied from the toner hoppers 101 to the developing tanks 111 via the toner transport mechanisms 102, respectively.

The cleaner units 4 each serve to remove and collect toner that remains on the surface of a corresponding one of the photoreceptor drums 3 after the steps of development and image transfer.

There is provided an intermediate transfer belt unit 8 above the photoreceptor drums 3. The intermediate transfer belt unit 8 includes: intermediate transfer rollers 6 (6*a*, 6*b*, 6*c*, and 6*d*); an intermediate transfer belt 7; an intermediate transfer belt driving roller 71; an intermediate transfer belt driven roller 72; an intermediate transfer belt tension mechanism 73; and an intermediate transfer belt cleaning unit 9.

The intermediate transfer belt 7 is suspended with tension and also is rotated in the direction indicated by arrow B in FIG. 2, by the intermediate transfer rollers 6, the intermediate transfer belt driving roller 71, the intermediate transfer belt driven roller 72, and the intermediate transfer belt tension mechanism 73.

The intermediate transfer rollers 6 are rotatably supported by an intermediate transfer roller mounting section of the intermediate transfer belt tension mechanism 73 included in the intermediate transfer belt unit 8. A transfer bias is applied on the intermediate transfer rollers 6. The transfer bias is used for transferring the toner images formed on the photoreceptor drums 3 onto the intermediate transfer belt 7.

The intermediate transfer belt 7 is provided in contact with each of the photoreceptor drums 3. The toner images of the color components formed on the photoreceptor drums 3 are sequentially transferred onto the intermediate transfer belt 7 so as to overlap one another. This forms a color toner image (multicolor toner image). The intermediate transfer belt 7 is made up of an endless film having a thickness in the range of, for example, 100 μm to 150 μm.

The toner images on the photoreceptor drums 3 are transferred onto the intermediate transfer belt 7 by the intermediate transfer rollers 6. The intermediate transfer rollers 6 are in contact with a reverse surface of the intermediate transfer belt 7. A high-voltage transfer bias for transferring toner images (the transfer bias having a high voltage of a polarity (+) reverse to a polarity (−) of the electrical charge of the toner) is applied on the intermediate transfer rollers 6.

The intermediate transfer rollers 6 includes a metal shaft (made of stainless steel, for example) as a base member. The metal shaft has a diameter of, for example, 8 to 10 mm. The intermediate transfer rollers 6 are covered on surface with an electrically conductive elastic material (for example, EPDM, urethane foam or the like). Due to this electrically conductive elastic material, the intermediate transfer rollers 6 are capable of applying a high voltage uniformly to the intermediate transfer belt 7. Although the present embodiment employs a transfer electrode having the form of a roller (the intermediate transfer rollers 6), the transfer electrode may also take the form of a brush or the like, other than a roller.

As described above, the electrostatic latent image on each of the photoreceptor drums 3 is visualized with the toner for a corresponding one of the color components so as to become a toner image. The toner images are laminated on one another on the intermediate transfer belt 7. The toner images thus laminated are carried by means of rotation of the intermediate transfer belt 7 to a position (transfer section) at which the intermediate transfer belt 7 comes into contact with a sheet of paper transported thereto. The toner images are then transferred onto the sheet of paper by a transfer roller 11 which is provided at the above position. At this stage, the intermediate transfer belt 7 and the transfer roller 11 are pressed against each other so as to have a predetermined nip, while a voltage for transferring the toner images onto the sheet of paper is applied on the transfer roller 11. This voltage is a high positive voltage reverse to of the negative electrical charge of the toner.

For the purpose of constantly maintaining the nip, one of the transfer roller 11 and the intermediate transfer belt driving roller 71 is made of a rigid material such as a metal, while the other one of the transfer roller 11 and the intermediate transfer belt driving roller 71 is, for example, an elastic roller made of a flexible material (i.e., a roller made of elastic rubber, foamed resin or the like).

The intermediate transfer belt cleaning unit 9 removes (i) toner which adheres to the intermediate transfer belt 7 due to contact between the intermediate transfer belt 7 and the photoreceptor drums 3, and (ii) toner which is not transferred from the intermediate transfer belt 7 onto the sheet of paper during the transfer of the toner image and therefore remains on the intermediate transfer belt 7. This is because the above toners (i) and (ii) cause mixing of toners of different colors in later transfer process. The intermediate transfer belt cleaning unit 9 includes a cleaning blade (cleaning member) in contact with the intermediate transfer belt 7. At a portion in contact with the cleaning blade, the intermediate transfer belt 7 is supported, from its reverse surface, by the intermediate transfer belt driven roller 72.

The paper feeding tray 10 serves to store sheets (e.g., recording paper) for use in image forming, and is provided below the image forming sections and the exposure unit 1. The paper output tray 15 is provided in an upper part of the image forming apparatus 200. Printed sheets are placed face down on the paper output tray 15.

The image forming apparatus 200 includes a sheet carrying path S for guiding sheets from the paper feeding tray 10 and those from a manual paper feeding tray 20 through the transfer section and the fixing unit 12 to the paper output tray 15. The transfer section lies between the intermediate transfer belt driving roller 71 and the transfer roller 11.

In the sheet carrying path S, there are provided: pickup rollers 16 (16*a*, 16*b*); a pair of resist rollers 14; the transfer section; the fixing unit 12; carrying rollers 25 (25*a* through 25*h*) and the like.

The carrying rollers 25 are small rollers provided in plurality along the sheet carrying path S so as to facilitate and aid the carrying of sheets. The pickup roller 16*a*, which is provided at an end of the paper feeding tray 10, is a feeding roller for supplying the sheets one by one from the paper feeding tray 10 to the sheet carrying path S. The pickup roller 16*b*, which is provided in the vicinity of the manual paper feeding tray 20, is a feeding roller for supplying the sheets one by one from the manual paper feeding tray 20 to the sheet carrying path S. The resist rollers 14 temporarily hold the sheet being carried along the sheet carrying path S, and feed the sheet to the transfer section at a timing which allows a front-end of the sheet to match with a front-end of the toner image on the intermediate transfer belt 7.

The fixing unit 12 includes a heat roller 81, a pressure roller 82 and the like. The heat roller 81 and the pressure roller 82 rotate in such a manner as to sandwich a sheet. The heat roller 81 is controlled by a control section (not shown) so as to have a predetermined fixing temperature. The control section controls the temperature of the heat roller 81 in accordance with a detection signal from a temperature detector (not shown). The heat roller 81 and the pressure roller 82 work together to apply heat and pressure on the sheet so that the toner images of the individual colors which have been transferred onto the sheet are melted, mixed, and pressured, to be thermally fixed on the sheet. The sheet on which the multicolor toner image (toner images of the individual colors) has been fixed is carried through an inversive paper output path in the sheet carrying path S by the multiple pairs of carrying rollers 25. The sheet is then discharged onto the paper output tray 15 in an inverted state (in which the multicolor toner image faces down).

The following description deals with the carrying of sheets in the sheet carrying path S. As described above, the image forming apparatus 200 includes the paper feeding tray 10 for storing sheets in advance and the manual paper feeding tray 20 used, for example, when a small number of sheets are printed. Each of the two trays is provided with a pickup roller 16, which feeds the sheets one by one into the sheet carrying path S.

As regards simplex printing, a sheet from the paper feeding tray 10 is carried to the resist rollers 14 by the carrying rollers 25*a* in the sheet carrying path S. The sheet is then carried by the resist rollers 14 to the transfer section at a timing which allows the front-end of the sheet to with the front-end of a multilayer toner image on the intermediate transfer belt 7. The toner image is transferred onto the sheet by the transfer section, and is then fixed on the sheet in the fixing unit 12. Subsequently, the sheet is carried through the carrying rollers 25*b*, and is then discharged from the paper output rollers (carrying rollers) 25*c* onto the paper output tray 15. When a sheet is fed from the manual paper feeding tray 20, the sheet is carried by multiple pairs of carrying rollers 25 (25*f*, 25*e*, 25*d*) to the pair of resist rollers 14. Thereafter, the sheet is carried in the same manner as a sheet supplied from the paper feeding tray 10, and is consequently discharged onto the paper output tray 15.

As regards duplex printing, when a sheet has passed the fixing unit 12 after simplex printing is completed in the way as described above, a rear end of the sheet is chucked by the paper output rollers 25*c*. Next, the paper output rollers 25*c* rotate in the reverse direction. This guides the sheet to the carrying rollers 25*g* and 25*h*. The sheet is then carried through the resist rollers 14 so that printing is performed on the reverse surface of the sheet. The sheet is consequently discharged onto the paper output tray 15.

[Arrangement of the Developing Device]

Figure 1:
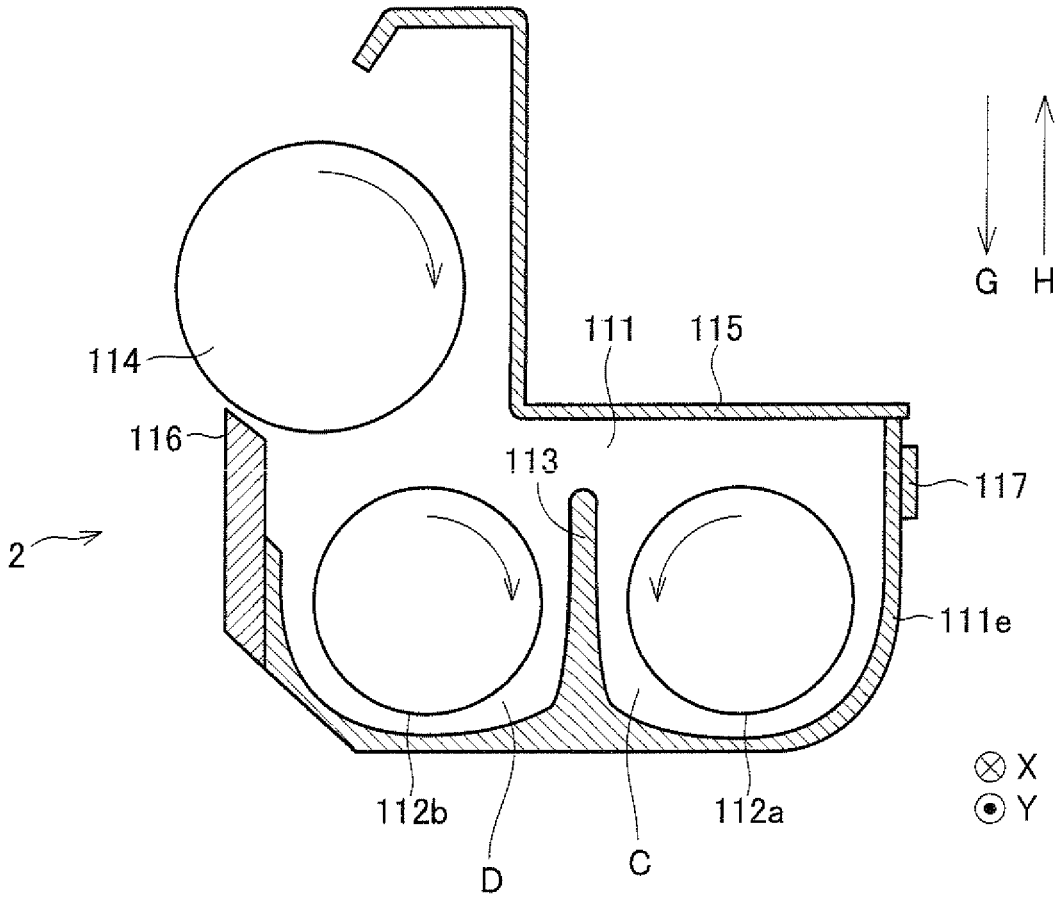
FIG. 1 is a schematic cross-sectional view of a developing device.
Figure 3:
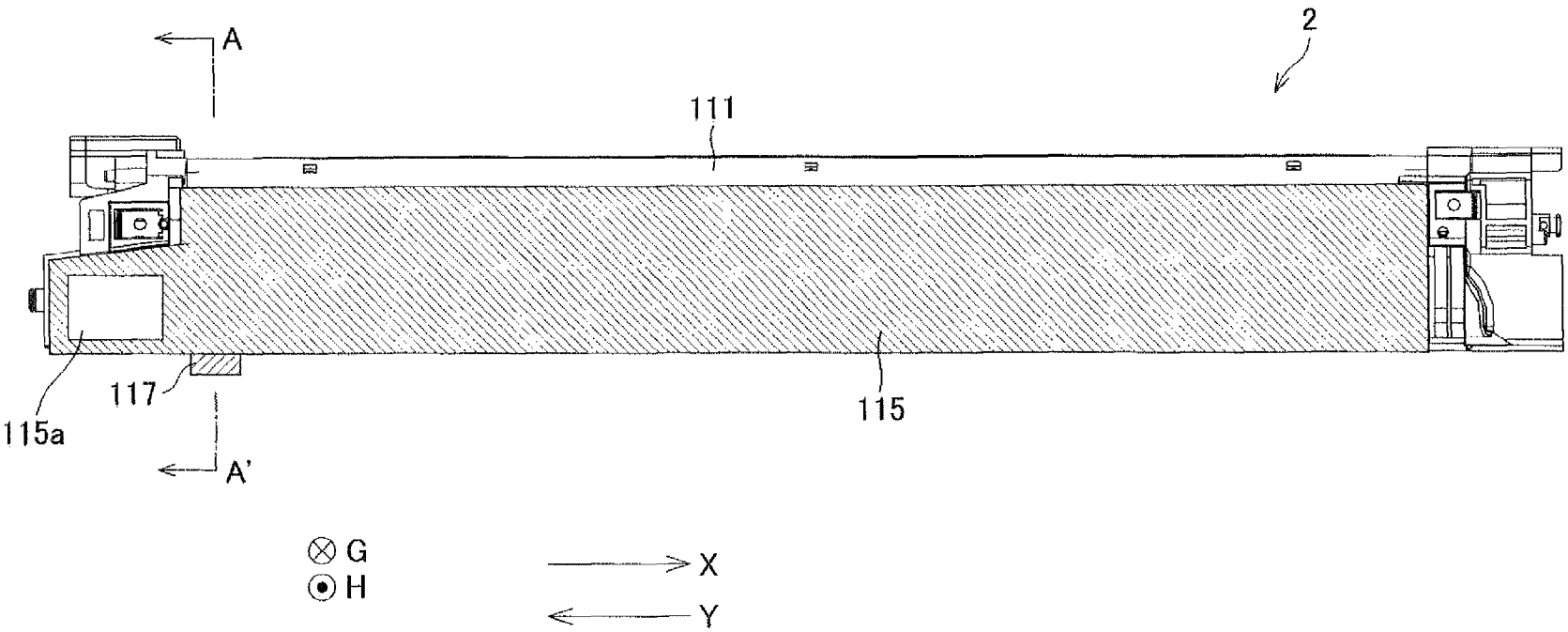
FIG. 3 is a plan view illustrating the developing device observed against the H direction.
Figure 4:
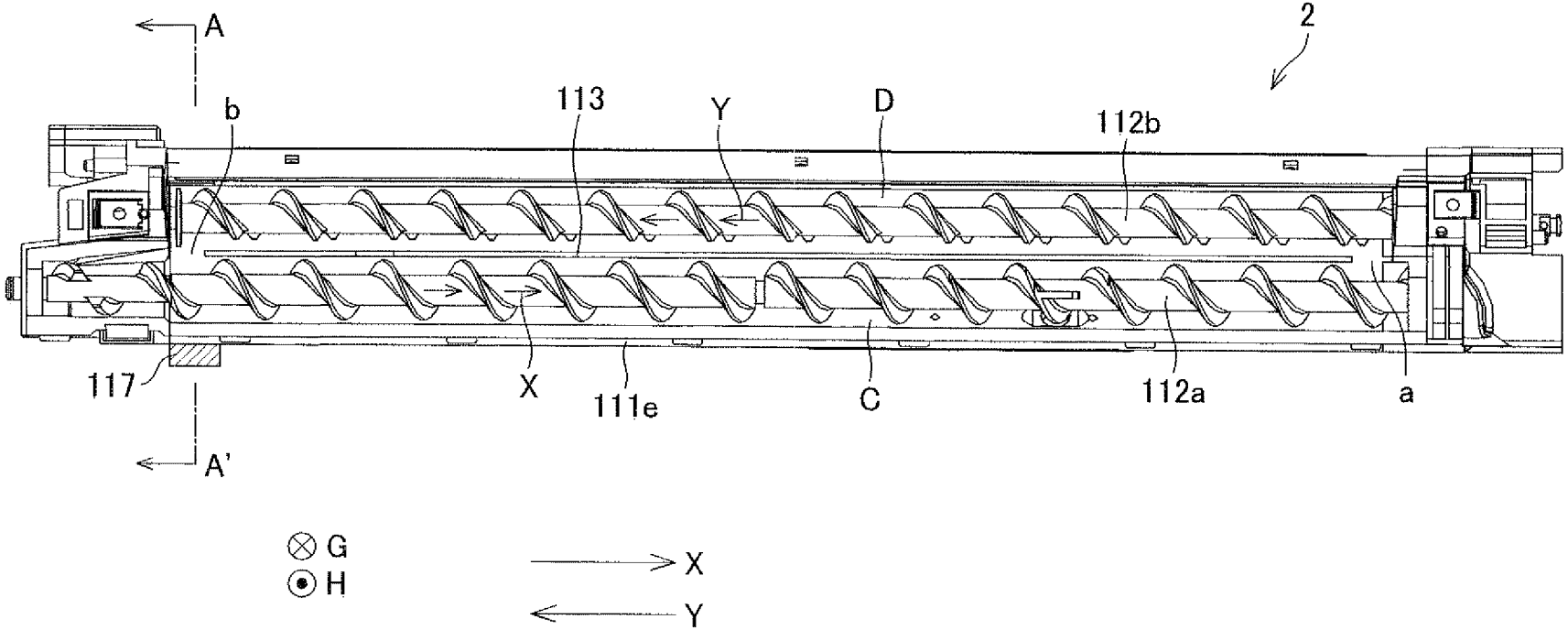
FIG. 4 is a plan view illustrating the developing device observed against the H direction shown in FIG. 1 when a developing tank cover is detached.

The following description deals in detail with the developing devices 2 included in the image forming apparatus 200. FIG. 1 is a schematic cross-sectional view of a developing device 2. FIG. 3 is a plan view illustrating the developing device observed against the H direction (i.e., from above). FIG. 4 is a plan view illustrating the developing device 2 observed against the H direction when a developing tank cover 115 shown in FIG. 3 is detached from the developing device 2. FIG. 1 is also a cross-sectional view taken along line A-A' of FIGS. 3 and 4. FIGS. 3 and 4 each illustrate the developing device 2 in which a developing roller 114 shown in FIG. 1 is omitted.

As illustrated in FIGS. 1 and 2, the developing device 2 includes a developing roller 114 disposed so as to face a photoreceptor drum 3. By supplying toner onto the surface of the photoreceptor drum 3 with use of the developing roller 114, the developing device 2 visualizes (develops) an electrostatic latent image formed on the surface of the photoreceptor drum 3.

As illustrated in FIG. 1, the developing device 2 includes, other than the developing roller 114: a developing tank 111; a developing tank cover (covering member) 115; a doctor blade 116; a first carrying screw (first carrying member) 112*a*; a second carrying screw (second carrying member) 112*b*; a partition plate (partition wall) 113; and a magnet 117.

The developing tank 111 is a tank that stores a developer including toner and carrier. The developing tank 111 is provided with the developing roller (developer bearing member) 114, the first carrying screw 112*a*, the second carrying screw 112*b* and the like. The carrier is magnetic carrier in the present embodiment.

The developing roller 114, which is a rotary magnet roller, attracts the developer in the developing tank 111 so as to bear it on its surface. The developing roller 114 supplies the toner included in the developer borne on its surface, onto the photoreceptor drum 3. The doctor blade (thickness controlling blade) 116 is provided adjacent to the surface of the developing roller 114.

As illustrated in FIGS. 1 and 3, the developing tank cover 115, which is detachable, is provided above the developing tank 111. Further, as illustrated in FIG. 3, the developing tank cover 115 has a toner supply opening 115*a* for supplying unused toner to the developing tank 111. Specifically, the toner from one of the toner hoppers 101 shown in FIG. 2 is transported via its corresponding toner transport mechanism 102 and the toner supply opening 115*a* to the developing tank 111. This makes it possible to supply the toner to the developing tank 111.

As illustrated in FIG. 4, the first carrying screw 112*a* and the second carrying screw 112*b* are each a screw-shaped roller (stirring roller) for stirring and carrying a developer in the developing tank 111. The first carrying screw 112*a* and the second carrying screw 112*b* each have a spiral-shaped stirring wing for stirring and carrying a developer. The shaft of each of the first carrying screw 112*a* and the second carrying screw 112*b* is rotated by driving means (not shown) such as a motor. This allows the first carrying screw 112*a* and the second carrying screw 112*b* to simultaneously stir and carry a developer.

As illustrated in FIGS. 1 and 4, the first carrying screw 112*a* and the second carrying screw 112*b* are disposed such that (i) their respective surfaces face each other via the partition plate 113, and that (ii) their respective shafts lie parallel to each other. Further, the first carrying screw 112*a* and the second carrying screw 112*b* rotate in opposite directions. The first carrying screw 112*a* carries the developer in the X direction shown in FIG. 4, whereas the second carrying screw 112*b* carries the developer in the Y direction, which is opposite from the X direction.

As illustrated in FIGS. 1 and 4, the developing tank 111 is provided with the partition plate 113 between the first carrying screw 112*a* and the second carrying screw 112*b*. The partition plate 113 is disposed so as to extend parallel to the axis direction (rotary shaft direction) of each of the first and second carrying screws 112*a* and 112*b*. The developing tank 111 is partitioned inside by the partition plate 113 into (i) a first carrying path C in which the first carrying screw 112*a* is provided and (ii) a second carrying path D in which the second carrying screw 112*b* is provided.

The second carrying path D is adjacent to the developing roller 114, and is therefore slightly narrower than the first carrying path C. Accordingly, the developer within the second carrying path D is higher in level than that within the first carrying path C.

As illustrated in FIG. 4, the partition plate 113 is disposed such that both ends thereof with respect to the axis direction of each of the first carrying screw 112*a* and the second carrying screw 112*b* are detached from an interior wall surface of the developing tank 111. In the developing tank 111, this forms communicating paths in the vicinity of both ends of each of the first carrying screw 112*a* and the second carrying screw 112*b* with respect to their respective axis directions. The communicating paths communicate the first carrying path C with the second carrying path D. Hereinafter, as indicated in FIG. 4, the communicating path formed downstream in the X direction is referred to as the first communicating path "a", whereas the communicating path formed downstream in the Y direction is referred to as the second communicating path "b".

According to the present embodiment, as illustrated in FIGS. 3 and 4, the toner supply opening 115*a* is positioned to open to a region of the first carrying path C, the region being located downstream of the second communicating path b in the Y direction. This makes it possible to supply the toner into the region of the first carrying path C, the region being located downstream of the second communicating path b in the Y direction.

Further, as illustrated in FIGS. 1 and 4, the present embodiment uses a magnet 117 for forming a magnetic field in the first carrying path C. The magnet 117 is mounted on an outer surface of a side wall 111*e* which is among the walls of the developing tank 111 and which forms the first carrying path C. The magnet 117 is positioned downstream of the toner supply opening 115*a* in the X direction. The magnet 117 forms a magnetic field in the first carrying path C so that a magnetic brush like ears of plant is formed from the carrier in the first carrying path C. The magnet 117 will be described later in detail.

[Stirring and Mixing of a Developer]

The following description deals in detail with stirring and mixing of a developer by the developing device 2. In the developing tank 111, the first carrying screw 112*a* and the second carrying screw 112*b* are rotated by driving means (not shown) such as a motor so as to carry a developer. Specifically, in the first carrying path C, the developer is simultaneously stirred and carried in the X direction by the first carrying screw 112*a*, and thereby arrives at the first communicating path a. The developer that has arrived at the first communicating path a is carried through the first communicating path a to the second carrying path D. Subsequently, in the second carrying path D, the developer is simultaneously stirred and carried in the Y direction by the second carrying screw 112*b*, and thereby arrives at the second communicating path b. The developer that has arrived at the second communicating path b is carried through the second communicating path b to the first carrying path C. In other words, the first carrying screw 112*a* and the second carrying screw 112*b* simultaneously stir and carry the developer in their respective carrying directions that are opposite from each other.

As described above, the developer is circulated in the developing tank 111 through the first carrying path C, the first communicating path a, the second carrying path D, and the second communicating path b, in this order. The developer carried in the second carrying path D attaches to the surface of the developing roller 114 and is picked up by means of rotation of the developing roller 114. Then, the toner in the developer that has been picked up is moved to the photoreceptor drum 3, at which the toner is consumed.

Fresh toner is supplied through the toner supply opening 115*a* to the first carrying path C so as to replenish the toner consumed as above. It is necessary that the toner thus supplied be mixed and stirred together with the developer that has been in the first carrying path C already.

However, if the developer in the first carrying path C is merely stirred together with the supplied toner by the first carrying screw 112*a* without the magnet 117 shown in FIG. 1 being provided, the toner supplied to the first carrying path C might form aggregates. Such toner aggregates are poorly mixed with the developer that has been in the first carrying path C already. Unmixed toner aggregates would be carried in such a manner as to slide on the upper surface of the developer (i.e., on the boundary between the developer and the air). The reason for this is as follows: The toner has an extremely lower specific gravity than that of the developer including the toner and the carrier. The specific gravity of the toner is about 0.35 g/cc, whereas that of the developer is about 2 g/cc, although these values slightly vary depending on the kinds of the toner and the carrier. This allows the aggregation of the toner supplied to the first carrying path C, and thereby prevents the toner from being mixed with the developer that has been in the first carrying path C already. This in turn causes the toner to be carried in such a manner as to slide on the upper surface of the developer. This will be further described in detail with reference to drawings.

Figure 5:
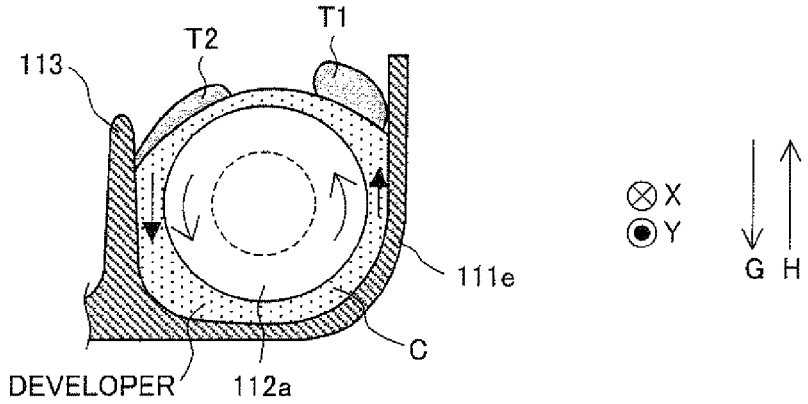
FIG. 5 is a schematic view illustrating a first carrying path in a developing tank, observed immediately after toner is supplied through a toner supply opening.
Figure 6:
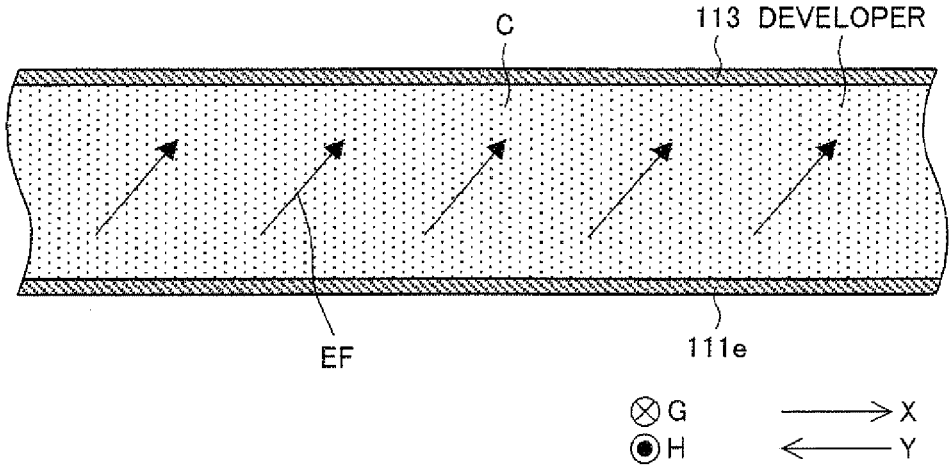
FIG. 6 is a schematic view illustrating an interior of the first carrying path observed against the H direction side shown in FIG. 1, the schematic view showing a direction of flow of a developer carried in the first carrying path.
Figure 7:
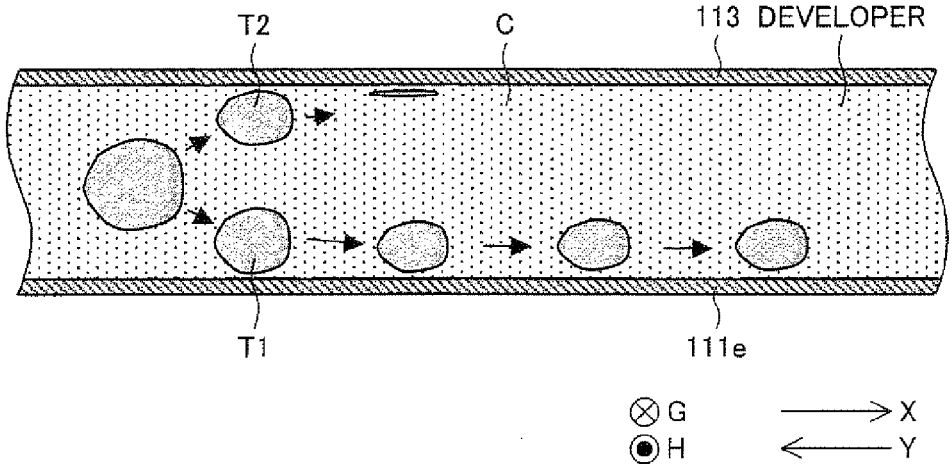
FIG. 7 is a schematic view illustrating the interior of the first carrying path observed against the H direction shown in FIG. 1, the schematic view showing the developer and toner aggregates carried in the first carrying path.

FIG. 5 is a schematic view illustrating the interior of the first carrying path C. FIG. 6 is a schematic view illustrating the interior of the first carrying path C observed against the H direction, the schematic view showing a direction of flow of a developer carried in the first carrying path C. FIG. 7 is a schematic view illustrating the interior of the first carrying path C observed against the H direction, the schematic view showing the developer and toner aggregates carried in the first carrying path C. In FIGS. 5 through 7, the dotted area represents a developer. The dotted circle in FIG. 5 indicates a shaft of the first carrying screw 112*a*. In FIGS. 6 and 7, the developing tank cover 115 is omitted.

As illustrated in FIGS. 5 and 6, in the first carrying path C, the developer is stirred so as to move around the first carrying screw 112*a* and to flow in the EF direction. This carries the developer in the X direction in the first carrying path C.

As illustrated in FIG. 5, as the toner is supplied through the toner supply opening 115*a* to the first carrying path C, part of the toner supply remains between the first carrying screw 112*a* and the side wall 111*e*, while other part of the toner supply remains between the first carrying screw 112*a* and the partition plate 113. In other words, the toner remains on the upper surface of the developer, in vicinity of or on the side wall 111*e*, and in vicinity of or on the partition plate 113.

Hereinafter, the toner that remains between the first carrying screw 112*a* and the side wall 111*e* is referred to as toner aggregate T1, whereas the toner that remains between the first carrying screw 112*a* and the partition plate 113 is referred to as the toner aggregate T2.

As illustrated in FIGS. 5 and 7, the toner aggregate T2 is efficiently mixed with the developer because the toner aggregate T2 is moved in the X direction and downwardly into the developer in association with the downward flow of the developer. In contrast, as illustrated in FIGS. 5 and 7, the toner aggregate T1 is in contact with the developer flowing upwardly. Thus, in the vicinity of or on the side wall 111*e*, the toner aggregate T1 carried in the X direction remains on top of the upper surface of the developer. This prevents the toner aggregate T1 from being mixed efficiently with the developer. As a result, the aggregates of the toner unmixed with the developer are carried in the X direction in the first carrying path C.

In order to solve this problem, the developing device 2 of the present embodiment attains efficient mixing of the toner aggregate T1 and the developer by being provided with the magnet 117 for forming a magnetic field in the first carrying path C. The magnet 117 is mounted on the outer surface of the side wall 111*e* of the developing tank 111. The following description deals with the reason the toner aggregate T1 and the developer are efficiently mixed with each other by use of the magnet 117.

Figure 8:
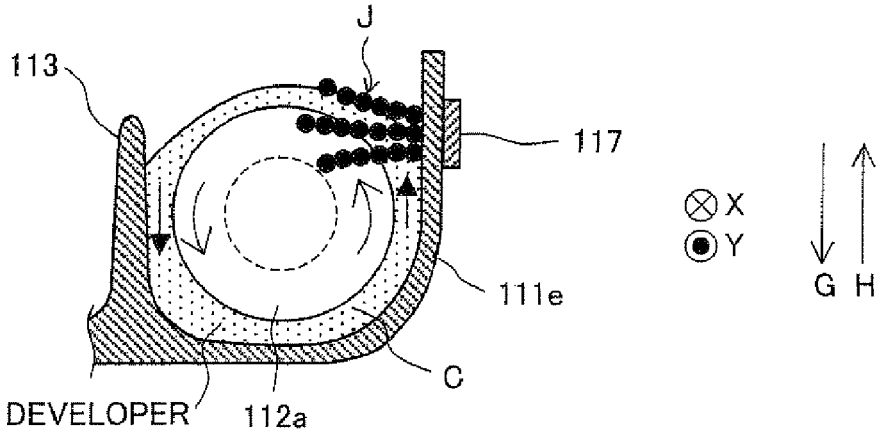
FIG. 8 is a schematic view illustrating how a magnetic brush is formed in the first carrying path due to a magnetic field generated by a magnet provided on a side wall of the developing tank.
Figure 9:
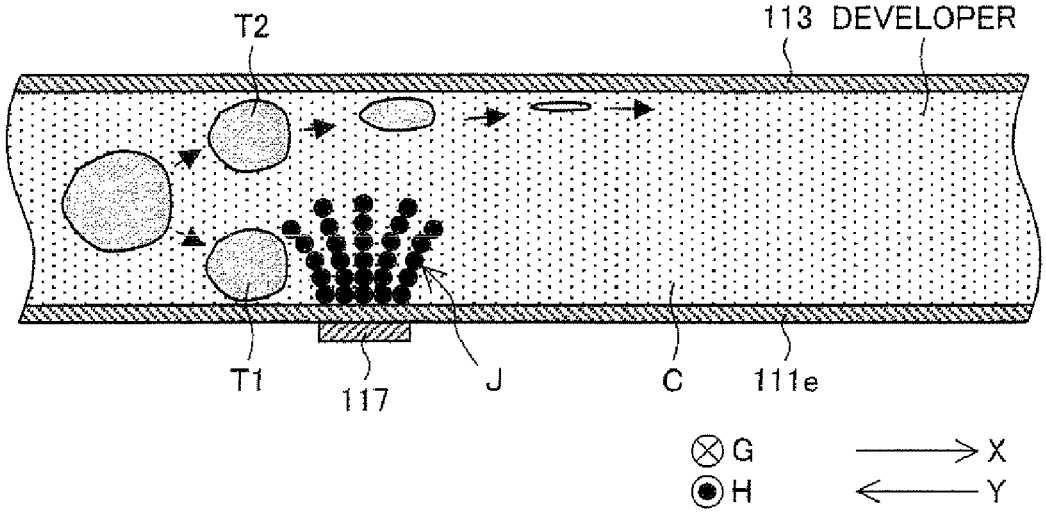
FIG. 9 is a schematic view illustrating the first carrying path shown in FIG. 8, observed against the H direction.

FIG. 8 is a schematic view illustrating how a magnetic brush J is formed in the first carrying path C due to a magnetic field generated by the magnet 117 provided on the side wall 111*e* of the developing tank 111. FIG. 9 is a schematic view illustrating the first carrying path C shown in FIG. 8, observed against the H direction. The dotted area in FIGS. 8 and 9 represents a developer.

As illustrated in FIGS. 8 and 9, the magnet 117 is mounted on the outer surface of the side wall 111*e* of the developing tank 111, in such a manner as to (i) face against the upper surface of the developer in the first carrying path C and to (ii) be positioned downstream of the toner supply opening 115*a* in the X direction. This allows, as illustrated in FIGS. 8 and 9, the magnetic brush J to be formed in the first carrying path C, in the upper surface of the developer, at downstream of the toner supply opening 115*a* in the X direction. The magnetic brush J is formed so as to extend from the side wall 111*e* to the shaft of the first carrying screw 112*a*.

The magnetic brush J impedes the flow of the developer and the toner aggregate T1 in the first carrying path C. Specifically, as illustrated in FIGS. 8 and 9, the flow of the developer and the toner aggregate T1 is temporarily stemmed by the magnetic brush J at the boundary between the developer and the toner aggregate T1. The toner aggregate T1 is trapped by the magnetic brush J until the toner in the toner aggregate T1 is mixed with the developer. This prevents the supplied toner from being carried in the form of aggregates in the first carrying path C, and thereby allows the supplied toner to be efficiently mixed with the developer. This mixing enables sufficient electrical charging of toner. Thus, toner sufficiently electrically charged can be supplied onto the developing roller 114. This consequently reduces problematic photographic fog in images and scattering of toner.

As described above, the developing device 2 of the present embodiment includes: first and second carrying paths C and D for carrying a developer including toner and carrier; a first carrying screw 112*a* for simultaneously stirring the developer and carrying the developer in the first carrying path C in the X direction (a predetermined direction); a second carrying screw 112*b* for simultaneously stirring the developer and carrying the developer in the second carrying path D in the Y direction (an opposite direction from the predetermined direction); a first communicating path a communicating the first carrying path C with the second carrying path D; a second communicating path b communicating the first carrying path C with the second carrying path D, the second communicating path b being formed downstream of the first communicating path a in the Y direction; and a developing roller for bearing the developer in the second carrying path D so as to supply the toner included in the developer onto a photoreceptor drum 3, the toner being supplied through a toner supply opening 115*a* to the first carrying path C, wherein the developing device 2 includes a magnet 117 for forming a magnetic brush J from the carrier in the first carrying path C. According to the developing device 2 described above, even when the developer that has been in the first carrying path C already and a toner aggregate T1 formed of supplied toner are carried in the first carrying path C while remaining separate from each other, the flow of the developer and the toner aggregate T1 is temporarily stemmed by the magnetic brush J so that the toner aggregate T1 is trapped by the magnetic brush J until the toner in the toner aggregate T1 is mixed with the developer. This prevents toner from being carried in the form of aggregates through the first carrying path C to the second carrying path D, and thereby prevents insufficiently charged toner from being supplied onto the developing roller 114. This consequently reduces problematic scattering of toner and photographic fog in images.

Further, according to the developing device 2 of the present embodiment, the mounting position of the magnet 117 is determined so that, in the first carrying path C, the magnetic brush J is formed downstream of a supply position in the X direction, the supply position being a position to which the toner is supplied through the toner supply opening 115*a*. This allows the magnetic brush J to be formed in the first carrying path C, at downstream of the supply position in the developer carrying direction (direction in which a developer is carried in the first carrying path). This in turn allows supplied toner in the form of aggregates to be efficiently trapped by the magnetic brush, and thereby more efficiently prevents the toner from being carried in the form of aggregates.

In the present embodiment, the magnetic brush J is formed in the first carrying path C, at downstream of the toner supply opening 115*a* in the X direction. The magnetic brush J is preferably formed as closely as possible to the toner supply opening 115*a*. This is because the more closely to the toner supply opening 115*a* the magnetic brush is formed, the sooner after toner is supplied through the toner supply opening 115*a* the toner can be mixed with the developer.

Further, according to the developing device 2 of the present embodiment, as illustrated in FIG. 8, the mounting position of the magnet 117 is determined so that, in the first carrying path C, the magnetic brush J is formed on a boundary between the developer and the air (i.e., on the upper surface of the developer). This allows the magnetic brush to efficiently trap the toner aggregate T1 that is carried in such a manner as to slide on the upper surface of the developer, thereby allowing the toner in the toner aggregate T1 to be mixed efficiently with the developer without overly increasing the stirring torque. For the purpose of forming the magnetic brush J in the upper surface of the developer, the magnet 117 is preferably mounted either on the outer wall surface of the side wall 111*e* as in the present embodiment, or on a wall surface of a partition member 113.

The developing device 2 is set such that toner is supplied by degrees so that the toner density of the developer stored in the developing tank 111 is maintained substantially at a constant level. This allows the surface height of the developer in the first carrying path C to be maintained substantially at a constant level even when the toner is consumed as a result of a developing process. This in turn allows the surface height of the developer in the second carrying path D to be maintained substantially at a constant level as well. This consequently allows the magnet 117 to be positioned so that the magnetic brush J is formed constantly in the upper surface of the developer in the first carrying path C.

Further, according to the developing device 2 of the present embodiment, as illustrated in FIG. 8, the mounting position of the magnet 117 is determined so that the magnetic brush J is formed on a portion of the side wall 111*e* forming the first carrying path C, the portion being in contact with the upper surface of the developer. This allows, as illustrated in FIGS. 8 and 9, the magnetic brush to efficiently trap the toner aggregate T1 that is carried in such a manner as to slide on the above upper surface while remaining adjacent to or on a wall surface of the side wall 111*e*, and thereby allows the toner in the toner aggregate T1 to be mixed efficiently with the developer without overly increasing the stirring torque.

The magnet 117 is preferably mounted either on the outer wall surface of the side wall 111*e* as in the present embodiment, or on a wall surface of the partition member 113, for the purpose of forming the magnetic brush J on a portion of the side wall 111*e*, the portion being in contact with the upper surface of the developer.

Further, according to the developing device 2 of the present embodiment, as illustrated in FIG. 8, the magnet 117 is positioned so that the magnetic brush J is formed in a region by which the shaft of the first carrying screw 112*a* is surrounded and in which the developer flows upward from below. Without this positioning of the magnet 117, a toner aggregate would likely remain on the upper surface of the developer, in a region in which the developer flows upward from below. In view of this, the magnetic brush J is formed in such a region so that the toner aggregate and the developer are mixed with each other efficiently. In the developing device 2 of the present embodiment, for the purpose of forming the magnetic brush J in the region in which the developer flows upward from below, it is necessary that the magnet 117 be mounted on the side wall 111*e* as illustrated in FIG. 8. However, it should be noted that, if the first carrying screw 112*a* is set so as to rotate in the direction reverse to the direction indicated in FIG. 8, it is necessary that the magnet 117 be mounted on the partition member 113, for the purpose of forming the magnetic brush J in the region in which the developer flows upward from below.

Further, according to the developing device 2 of the present embodiment, as illustrated in FIG. 8, the magnetic force and the mounting position (particularly, with regard to the shortest distance between the magnet 117 and the shaft of the first carrying screw 112*a*) of the magnet 117 are designed so that the front end of the magnetic brush J is in contact with the shaft of the first carrying screw 112*a*. This allows ensuring that the developer stirred by rotation of the first carrying screw 112*a* is rubbed by the magnetic brush, and consequently allows the toner aggregate T1 trapped by the magnetic brush to be efficiently mixed with the developer. According to the present embodiment, the shortest distance between the magnet 117 and the shaft of the first carrying screw 112*a* is 8 mm, and the magnet 117 in use has a magnetic force with a magnetic flux density that ranges from 10 mT to 30 mT in measurements at the position where the distance between the magnet 117 and the shaft of the first carrying screw 112*a* is 8 mm.

Alternatively, a magnet having a stronger magnetic force may be mounted on the side wall 111*e* so as to form a magnetic brush that is in contact with the side wall 111*e* at one end, and that is also in contact with the partition plate 113 at the other end, the magnetic brush stemming the flow of both of the toner aggregates T1 and T2. This also allows supplied toner to be efficiently mixed with the developer. It should be noted, however, that use of a magnet having an overly strong magnetic force may excessively decrease the fluidity of the developer, and conversely hinder the stirring and mixing of the toner aggregates T1 and T2 with the developer. In view of this, the magnetic force of the magnet 117 needs to be set so as not to hinder the above stirring and mixing.

Further, the magnet 117 may be positioned so that the magnetic brush J is formed in the first carrying path C, at the supply position at which toner is supplied through the toner supply opening 115*a*. Even in this case, it is indeed possible to mix supplied toner with the developer; however, this necessitates securing ample space between the developer in the first carrying path C and the toner supply opening 115*a* so that toner is supplied smoothly. Thus, the arrangement of the present embodiment is preferable to such an arrangement in which the magnetic brush J is formed at the supply position.

Other Embodiments

Figure 10:
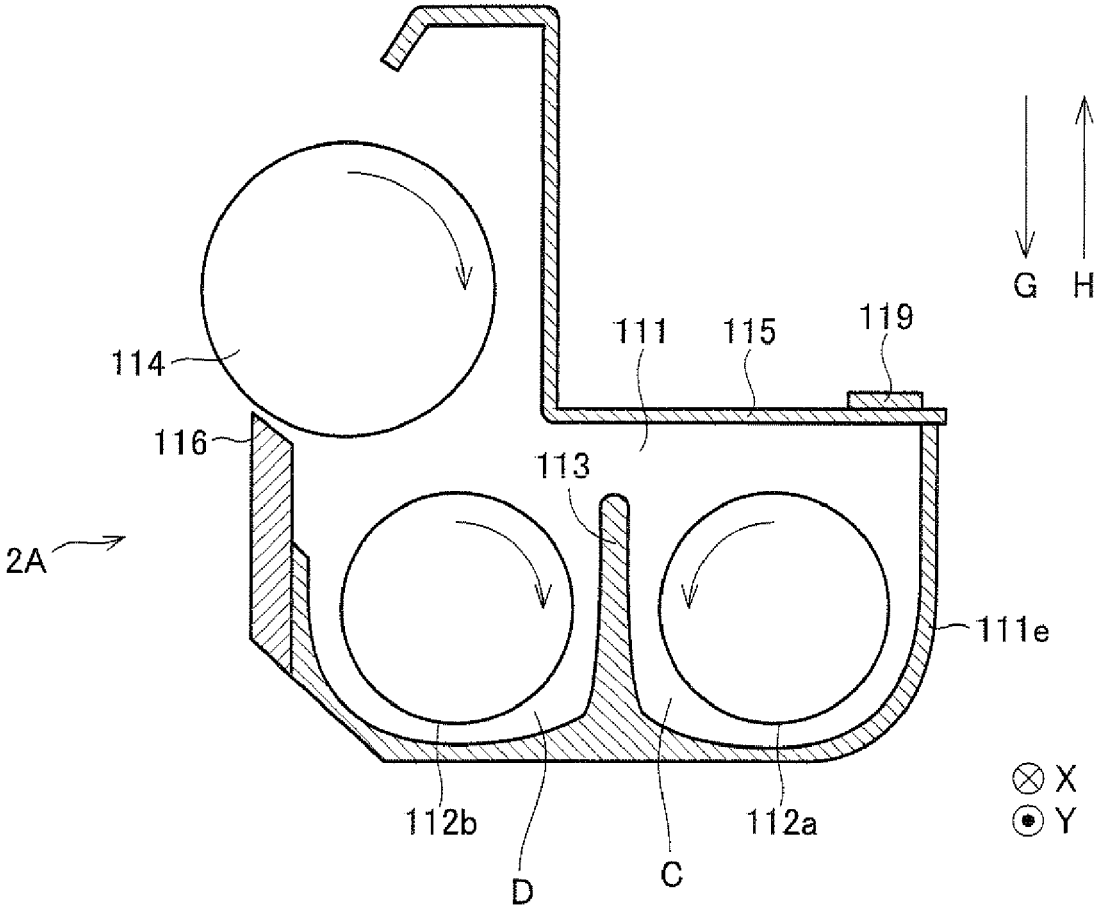
FIG. 10 is a cross-sectional view illustrating a developing device.

FIG. 10 is a cross-sectional view illustrating a developing device 2A. The developing device 2A is different from the developing device 2 in that the developing device 2A has a magnet 119 mounted thereon in place of the magnet 117. Except for this difference, the arrangement of the developing device 2A is the same as that of the developing devices 2.

As illustrated in FIG. 10, the magnet 119 is mounted on the front surface of the developing tank cover 115 (i.e., the outer surface of the developing tank 111). As such, the developing device 2A is arranged such that a magnetic brush is formed so as to extend from a rear surface of the developing tank cover 115 (i.e., an inner surface of the developing tank 111) to the upper surface of a developer in the first carrying path C (i.e., a boundary between the developer and the air). This allows the carrier adhering to the developing tank cover 115 to be readily removed in detaching the developing tank cover 115 for the purpose of replacing the developer inside the developing tank 111. This significantly improves the efficiency in developer replacement, as compared to the case in which the magnet 113 is provided on the side wall 111*e* of the developing tank 111 or on the partition plate 113.

The mounting position of the magnet 119 in the developing device 2A is also determined so that the magnetic brush is formed in the first carrying path C, at downstream of the toner supply opening 115*a* in the X direction. Alternatively, the mounting position of the magnet 119 may be determined so that the magnetic brush is formed on a portion of the side wall 111*e* forming the first carrying path C, the portion being in contact with the upper surface of the developer. Further, the magnet 119 may be positioned so that the magnetic brush is formed in a region by which the shaft of the first carrying screw 112*a* is surrounded and in which the developer flows upward from below. Still further, the magnetic force and the mounting position of the magnet 119 may be designed so that the front end of the magnetic brush is in contact with the shaft of the first carrying screw 112*a*.

Figure 11:
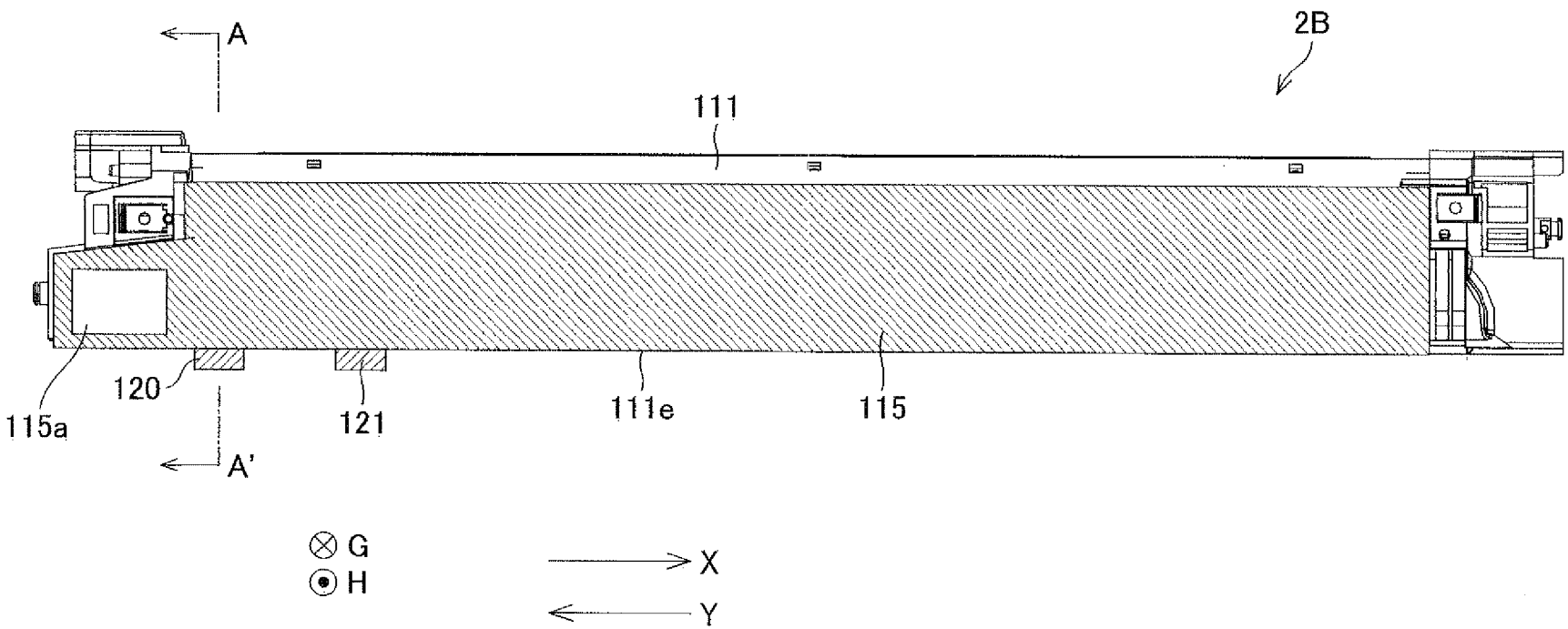
FIG. 11 is a plan view illustrating a developing device, the developing device being observed against the H direction.

FIG. 11 is a plan view illustrating a developing device 2B, the developing device 2B being observed against the H direction. The developing device 2B is different from the developing device 2 in that the developing device 2B has two magnets mounted thereon, namely a magnet (first magnet) 120 and a magnet (second magnet) 121, instead of providing a single magnet. Except for the this difference, the arrangement of the developing device 2B is identical with that of the developing device 2. In FIG. 11, the developing roller 114 is omitted.

As illustrated in FIG. 11, the magnets 120 and 121 are mounted on an outer surface of the side wall 111*e* forming the first carrying path C. Further, as illustrated in FIG. 11, the magnets 120 and 121 are provided downstream of the toner supply opening 115*a* in the X direction. In addition, as illustrated in FIG. 11, the magnets 120 and 121 are aligned with each other along the X direction, and are apart from each other. The magnets 120 and 121 have different polarities on their sides facing the first carrying path C.

Figure 12:
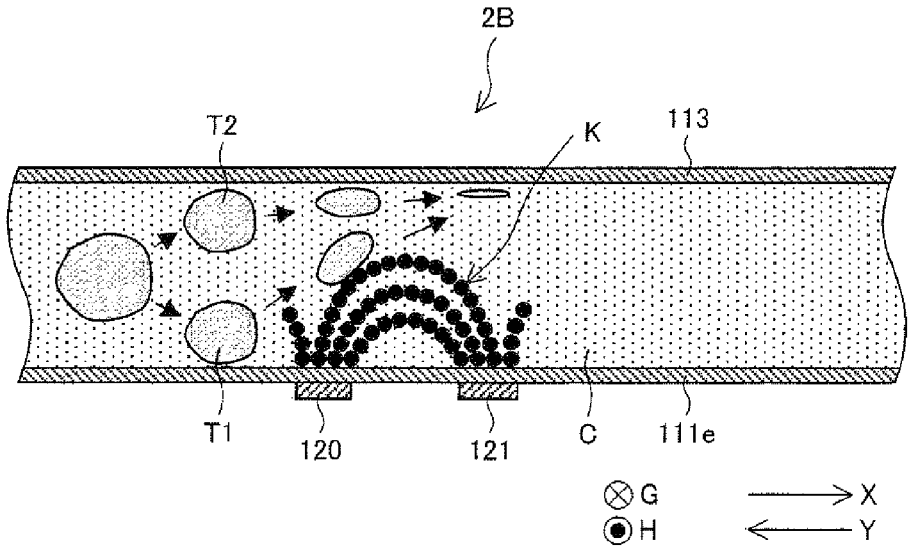
FIG. 12 is a plan view illustrating the developing device illustrated in FIG. 11, in which a developing tank cover is detached.

FIG. 12 is a plan view illustrating the developing device 2B observed against the H direction when the developing tank cover 115 is detached. The developing device 2B illustrated in FIG. 12 allows a magnetic brush generated by the magnetic force of the magnet 120 to be connected with a magnetic brush generated by the magnetic force of the magnet 121 so that a magnetic brush K in the form of a long chain is formed. This allows the magnetic brush K to efficiently trap the toner aggregate T1, and thereby more effectively prevents toner from being carried in the form of aggregates.

In further detail, the mounting position of each of the magnets 120 and 121 is determined so that the magnetic brush K is formed at the boundary between the developer and the air, in a region by which a shaft of the first carrying screw 112*a* is surrounded and in which a developer flows upward from below due to the stirring by the first carrying screw 112*a*. Further, the mounting position and the magnetic force of each of the magnets 120 and 121 are determined so that (i) one end of the magnetic brush K is attracted toward the magnet 120, while the other end of the magnetic brush K is attracted toward the magnet 121, and that (ii) the magnetic brush K takes the form of an arch.

In consequence, the developing device 2B allows forming a magnetic brush that is horizontally longer than the magnetic brush formed in the developing device 2, illustrated in FIG. 9. This allows the magnetic brush to efficiently trap supplied toner (i.e., temporarily stop the supplied toner being transported).

As described above, according to the developing device 2B illustrated in FIG. 12, the magnetic brush K is formed by the magnets 120 and 121 so as to take the form of an arch. As illustrated in FIG. 12, the magnetic brush K in the form of an arch causes the toner aggregate T1, which is carried in such a manner as to slide on the upper surface of the developer, to be guided to a region in which the developer is stirred downward from above (i.e., the side of the first carrying path C on which side the toner aggregate T2 is carried). This consequently allows the supplied toner to be mixed and charged more rapidly.

The toner thus mixed sufficiently with the developer is stirred by the first carrying screw 112*a* during the transportation through the first carrying path C, and is thereby electrically charged to a predetermined potential due to its friction with the carrier. Then the toner with the predetermined potential arrives at the second carrying path D. Consequently, by the time the toner is provided for development in the second carrying path D, the toner has already been electrically charged stably to the predetermined potential, and also a uniform and stable toner density has been achieved. This allows obtaining images free from photographic fog or scattering of toner.

Furthermore, the arrangement of the present embodiment can readily be achieved simply by mounting magnets on the side wall of the developing device 2. As such, the arrangement of the present embodiment has an advantage in that it does not necessitate designing a large device, and therefore it can be downsized, as compared to the arrangement of Patent Document 1 in which a plurality of screen members are provided around the shaft of a developer carrying member (carrying screw).

The mounting position of each of the magnets 120 and 121 in the developing device 2B illustrated in FIGS. 11 and 12 is also determined so that the magnetic brush K is formed in the first carrying path C, at downstream of the toner supply opening 115*a* in the X direction. Alternatively, the mounting position of each of the magnets 120 and 121 may be determined so that the magnetic brush K is formed on a portion of the side wall 111*e* forming the first carrying path C, the portion being in contact with the upper surface of the developer. Further, the magnets 120 and 121 may be positioned so that the magnetic brush K is formed in a region by which the shaft of the first carrying screw 112*a* is surrounded and in which the developer flows upward from below. Still further, the magnetic force and the mounting position of each of the magnets 120 and 121 may be designed so that the front end of at least one bristle of the magnetic brush K is in contact with the shaft of the first carrying screw 112*a*. In addition, the magnets 120 and 121 may be mounted on the developing tank cover 115.

A magnet for forming a magnetic brush J in the first carrying path C may preferably be positioned higher than the shaft of the first carrying screw 112*a*. This point will be explained below with reference to FIG. 13.

Figure 13:
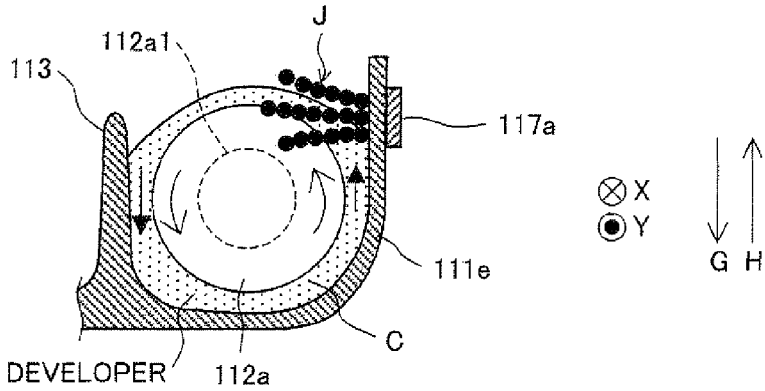
FIG. 13 is a view illustrating a developing device including a magnet positioned higher than a shaft of a first carrying screw.

A developing device of FIG. 13 has the same arrangement as of the developing device of FIG. 1, except for where a magnet is provided. The developing device illustrated in FIG. 13 is provided with a magnet 117*a* for forming the magnetic brush J in the first carrying path C, the magnet 117*a* being mounted on the side wall 111*e*. As illustrated in FIG. 13, the magnet 117*a* is positioned so that the lower end of the magnet 117*a* is located downstream of (i.e., above) the uppermost part of the shaft 112*a*1 of the first carrying screw 112*a* in the H direction. As a result, the magnet 117*a* for forming the magnetic brush J in the first carrying path C is disposed higher than the shaft of the first carrying screw 112*a*.

The arrangement of FIG. 13 described above allows suppressing the number of bristles of the magnetic brush, the bristles being in contact with the shaft of the carrying screw at their respective front ends, as compared to a developing device that is arranged such that a magnet for forming a magnetic brush in a carrying path, through which a developer is carried, is positioned as high as the shaft of a carrying screw in the carrying path.

Thus, as compared to the developing device in which the magnet is positioned as high as the shaft, the arrangement of FIG. 13 allows reducing an area of the shaft, the area being in contact with the magnetic brush, thereby reducing the amount of heat generated by friction between the shaft and the magnetic brush, and consequently suppressing aggregation of the developer.

The magnet 117*a* in the developing device of FIG. 13 is also mounted downstream of the toner supply opening 115*a* in the X direction. Further, the magnet 117*a* in the developing device of FIG. 13 may also be positioned so that the magnetic brush J is formed in the upper surface of the developer in the first carrying path C. Still further, the mounting position of the magnet 117*a* in the developing device of FIG. 13 may also be determined so that the magnetic brush is formed on a portion of the side wall 111*e* forming the first carrying path C, the portion being in contact with the upper surface of the developer. In addition, the magnet 117*a* in the developing device of FIG. 13 may also be positioned so that the magnetic brush J is formed in a region by which the shaft of the first carrying screw 112*a* is surrounded and in which the developer flows upward from below.

The developing device 2B illustrated in FIGS. 11 and 12 may also have an arrangement as illustrated in FIG. 13 in which the magnets 120 and 121 are positioned higher than the shaft of the first carrying screw 112*a*.

Figure 14:
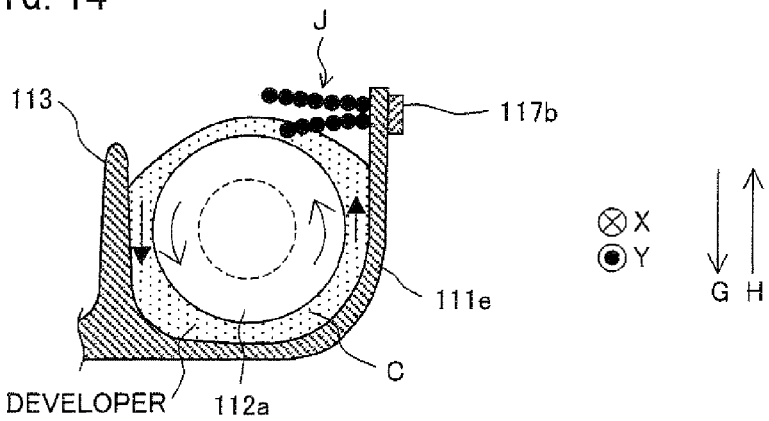
FIG. 14 is a view illustrating a developing device including a magnet positioned higher than an uppermost part of the first carrying screw.

A magnet for forming the magnetic brush J in the first carrying path C may preferably be positioned higher than the uppermost part of the first carrying screw 112*a*. This arrangement will be explained below with reference to FIG. 14. A developing device illustrated in FIG. 14 is arranged such that a magnet 117*b* for forming the magnetic brush J in the first carrying path C is mounted on the side wall 111*e*. As illustrated in FIG. 14, the magnet 117*b* is positioned so that the lower end of the magnet 117*b* is located downstream of (i.e., above) the uppermost part (i.e., a portion of the stirring wing, the portion corresponding to the upper portion of the screw) of the first carrying screw 112*a*, in the H direction. This allows the magnet 117*b* for forming the magnetic brush J in the first carrying path C to be positioned higher than the first carrying screw 112*a*.

The arrangement of FIG. 14 described above reduces the number of bristles of the magnetic brush, the bristles being in contact with the shaft of the carrying screw at their respective front ends. Furthermore, the arrangement of FIG. 14 also reduces the number of bristles of the magnetic brush, the bristles being in contact with the stirring wing of the carrying screw. As such, the arrangement of FIG. 14 allows further reducing an area of the shaft, the area being in contact with the magnetic brush, thereby further reducing the amount of heat generated by friction between the shaft and the magnetic brush, and consequently further suppressing the aggregation of the developer.

In each of the embodiments described above, the developing device includes: first and second carrying paths for carrying a developer including toner and magnetic carrier; a first carrying member provided in the first carrying path, the first carrying member simultaneously stirring the developer and carrying the developer in the first carrying path in a predetermined direction; a second carrying member provided in the second carrying path, the second carrying member simultaneously stirring the developer and carrying the developer in the second carrying path in an opposite direction to the predetermined direction; a first communicating path communicating the first carrying path with the second carrying path; a second communicating path communicating the first carrying path with the second carrying path, the second communicating path being formed downstream of the first communicating path in the opposite direction; and a developer bearing member for bearing the developer in the second carrying path so as to supply the toner included in the developer onto a photoreceptor, the toner being supplied through a supply opening to the first carrying path, the developer being circulatively carried through the first carrying path, the first communicating path, the second carrying path, and the second communicating path in this order, the developing device comprising a magnet for forming a magnetic brush in the first carrying path, the magnetic brush being formed from the magnetic carrier.

Therefore, even when the developer that has been in the first carrying path already and a toner aggregate formed of supplied toner are carried in the first carrying path while remaining separate from each other, the flow of the developer and the toner aggregate is temporarily stemmed by the magnetic brush so that the toner aggregate is trapped by the magnetic brush until the toner in the toner aggregate is mixed with the developer. This prevents the toner from being carried in the form of aggregates through the first carrying path to the second carrying path, and thereby prevents such a problem that toner with insufficient electrical charge is supplied onto the developer bearing member. This consequently reduces problematic scattering of toner and photographic fog in images.

In other words, according to the above developing device, since the toner aggregate is trapped by the magnetic brush until the toner in the toner aggregate is mixed with the developer, the toner can be sufficiently mixed with the developer, and this mixing enables sufficient charging of toner by means of friction between the toner and the carrier, and in turn allows sufficiently charged toner to be supplied onto the developer bearing member. This consequently reduces problematic scattering of toner and photographic fog in images.

In addition to the above arrangement, the developing device may preferably be arranged such that a mounting position of the magnet is determined so that, in the first carrying path, the magnetic brush is formed downstream of a supply position in the predetermined direction, the supply position being a position to which toner is supplied through the supply opening. This allows the magnetic brush to be formed downstream of the supply position in the developer carrying direction (direction in which a developer is carried in the first carrying path). This in turn allows the toner aggregate to be efficiently trapped by the magnetic brush, and thereby more efficiently prevents the toner from being carried in the form of aggregates.

The toner aggregate is often carried in such a manner as to slide on the boundary between the developer and the air (i.e., on the upper surface of the developer). In view of this, the developing device may preferably be arranged such that a mounting position of the magnet is determined so that the magnetic brush is formed in the first carrying path, at a boundary between the developer and air. This allows the magnetic brush to efficiently trap the toner aggregate, thereby allowing the toner in the toner aggregate to be mixed efficiently with the developer without overly increasing the developer stirring torque.

In addition, the toner aggregate is often carried in such a manner as to slide on the boundary, adjacent to or on a wall forming the first carrying path. In view of this, the developing device may preferably be arranged such that the mounting position of the magnet is determined so that the magnetic brush is formed on a portion of a wall forming the first carrying path, the portion being in contact with the boundary. This allows the magnetic brush to efficiently trap the toner aggregate, thereby allowing the toner in the toner aggregate to be mixed efficiently with the developer without overly increasing the developer stirring torque.

Further, the toner aggregate is likely to be formed on the surface of the developer in the first carrying path, in a region in which the developer flows upward from below. In view of this, in addition to the above arrangement, the developing device may preferably be arranged such that the first carrying member is a screw member rotating so as to simultaneously stir the developer and carry the developer in the predetermined direction in the first carrying path, and that a mounting position of the magnet is determined so that the magnetic brush is formed in a region by which the shaft of the screw member is surrounded and in which the developer flows upward from below due to the stirring by the first screw. This allows the magnetic brush to efficiently trap the toner aggregate, thereby allowing the toner in the toner aggregate to be mixed efficiently with the developer.

In addition to the above arrangement, the developing device may preferably be arranged such that the first carrying member is a screw member rotating so as to simultaneously stir the developer and carry the developer in the predetermined direction in the first carrying path, and that a mounting position and a magnetic force of the magnet are determined so that a front end of the magnetic brush is in contact with the shaft of the screw member. This facilitates rubbing with the magnetic brush the developer which is stirred by means of rotation of the screw member so as to move around the screw member, thereby allowing the toner aggregate trapped by the magnetic brush to be efficiently mixed with the developer.

In addition to the above arrangement, the developing device may preferably further include a covering member covering the first carrying path, the covering member being detachable from the developing device, wherein the magnet is mounted on the covering member. This allows the magnetic carrier adhering to the covering member to be readily removed when the covering member is detached for replacement of the developer in the first carrying path, and consequently improves the efficiency in developer replacement significantly, as compared to an arrangement in which the magnet is provided on an undetachable wall of the developing device.

In addition to the above arrangement, the developing device may preferably further include a second magnet other than the magnet being a first magnet, wherein the first and second magnets are mounted on an outer surface of a wall forming the first carrying path, and are aligned with each other along the predetermined direction; and the first magnet and the second magnet have different polarities on their sides facing the first carrying path. This allows a magnetic brush generated by the magnetic force of the first magnet to be connected with a magnetic brush generated by the magnetic force of the second magnet so that a magnetic brush in the form of a long chain is formed. This in turn allows the magnetic brush to efficiently trap the toner aggregate, and thereby more effectively prevents toner from being carried in the form of aggregates.

The developing device of the present embodiment is included in an electrophotographic image forming apparatus. Examples of such an image forming apparatus encompass a printer, a copier, a multifunction printer, and a facsimile machine.

The technology is not limited to the description of the embodiments above, but may be altered by a skilled person within the scope of the claims. An embodiment based on a proper combination of technical means disclosed in different embodiments is encompassed in the technical scope of the technology.

The embodiments and concrete examples of implementation discussed in the foregoing detailed explanation serve solely to illustrate the technical details of the technology, which should not be narrowly interpreted within the limits of such embodiments and concrete examples, but rather may be applied in many variations within the spirit of the technology, provided such variations do not exceed the scope of the patent claims set forth below.

What is claimed is:

1. A developing device comprising:

first and second carrying paths for carrying a developer including toner and magnetic carrier;

a first screw provided in the first carrying path, the first screw rotating so as to simultaneously stir the developer and carry the developer in the first carrying path in a first direction;

a second screw provided in the second carrying path, the second screw rotating so as to simultaneously stir the developer and carry the developer in the second carrying path in a second direction that is opposite the first direction;

a first communicating path communicating the first carrying path with the second carrying path;

a second communicating path communicating the first carrying path with the second carrying path, the second communicating path being formed downstream of the first communicating path in the second direction; and a developer bearing member for bearing the developer in the second carrying path so as to supply the toner included in the developer onto a photoreceptor, the toner being supplied through a supply opening to the first carrying path, the developer being circulatively carried through the first carrying path, the first communicating path, the second carrying path, and the second communicating path, in this order, wherein the developing device comprises first and second magnets that are mounted on the same outer surface of a wall forming the first carrying path at a position higher than a shaft of the first screw, the first and second magnets being aligned with each other along the first direction, the first magnet and the second magnet having different polarities on their sides facing the first carrying path, the first and second magnets forming a magnetic brush from the magnetic carrier in the first carrying path, wherein a mounting position of each of the first and second magnets is determined so that:

the magnetic brush is formed on a boundary between the developer and air, in a region by which the shaft of the first screw is surrounded and in which the developer flows upward from below due to the stirring by the first screw; and a first end of the magnetic brush is attracted to the first magnet, while a second end of the magnetic brush is attracted to the second magnet, the magnetic brush having a form of an arch.

2. The developing device according to claim 1, wherein a mounting position of the first and second magnets is determined so that, in the first carrying path, the magnetic brush is formed downstream of a supply position in the first direction, the supply position being a position to which the toner is supplied through the supply opening.

3. The developing device according to claim 1, wherein the first and second magnets are is provided higher than an uppermost part of the first screw.

4. An electrophotographic image forming apparatus comprising:

a developing device, the developing device including:

first and second carrying paths for carrying a developer including toner and magnetic carrier;

a first screw provided in the first carrying path, the first screw rotating so as to simultaneously stir the developer and carry the developer in the first carrying path in a first direction;

a second screw provided in the second carrying path, the second screw rotating so as to simultaneously stir the developer and carry the developer in the second carrying path in a second direction that is opposite to the first direction;

a first communicating path communicating the first carrying path with the second carrying path;

a second communicating path communicating the first carrying path with the second carrying path, the second communicating path being formed downstream of the first communicating path in the second direction; and a developer bearing member for bearing the developer in the second carrying path so as to supply the toner included in the developer onto a photoreceptor, the toner being supplied through a supply opening to the first carrying path, the developer being circulatively carried through the first carrying path, the first communicating path, the second carrying path, and the second communicating path, in this successive order, wherein the developing device includes first and second magnets that are mounted on the same outer surface of a wall forming the first carrying path at a position higher than a shaft of the first screw, the first and second magnets being aligned with each other along the first direction, the first and second magnets having different polarities on their sides facing the first carrying path, the first and second magnets forming a magnetic brush from the magnetic carrier that extends horizontally in the first carrying path, wherein a mounting position of the first and second magnets is determined so that:

the magnetic brush is formed on a boundary between the developer and air, in a region by which the shaft of the first screw is surrounded and in which the developer flows upward from below due to the stirring by the first screw; and a first end of the magnetic brush is attracted to the first magnet, while a second end of the magnetic brush is attracted to the second magnet, the magnetic brush having a form of an arch.

* * * * *